US009782801B2

(12) United States Patent
Alamzad et al.

(10) Patent No.: US 9,782,801 B2
(45) Date of Patent: Oct. 10, 2017

(54) VIBRATORY SCREENER WITH AN ADAPTER FRAME

(71) Applicant: Kason Corporation, Millburn, NJ (US)

(72) Inventors: Hossein Alamzad, New York, NY (US); Jonathan Weiner, Short Hills, NJ (US); William Zhao, Livingston, NJ (US)

(73) Assignee: Kason Corporation, Millburn, NJ (US)

( * ) Notice: Subject to any disclaimer, the term of this patent is extended or adjusted under 35 U.S.C. 154(b) by 0 days.

(21) Appl. No.: 14/929,064

(22) Filed: Oct. 30, 2015

(65) Prior Publication Data

US 2016/0288170 A1 Oct. 6, 2016

Related U.S. Application Data

(60) Provisional application No. 62/143,618, filed on Apr. 6, 2015.

(51) Int. Cl.

| | |
|---|---|
| ***B07B 1/38*** | (2006.01) |
| ***B07B 1/42*** | (2006.01) |
| *B07B 1/28* | (2006.01) |

(52) U.S. Cl.

CPC ..... *B07B 1/42* (2013.01); *B07B 1/38* (2013.01); *B07B 1/28* (2013.01)

(58) Field of Classification Search

CPC .... B07B 1/28; B07B 1/38; B07B 1/42; B07B 1/46

USPC ..... 209/326, 332, 405

See application file for complete search history.

(56) References Cited

U.S. PATENT DOCUMENTS

| | | | | |
|---|---|---|---|---|
| 708,866 | A | 9/1902 | Comstock | |
| 2,284,671 | A * | 6/1942 | Meinzer | B06B 1/16 134/156 |
| 2,777,578 | A * | 1/1957 | Watson | B07B 1/38 209/243 |
| 2,950,819 | A * | 8/1960 | Holman | B07B 1/38 209/326 |
| 3,035,700 | A * | 5/1962 | McCausland | B07B 1/38 209/319 |
| 3,061,095 | A * | 10/1962 | O'Malley | B07B 1/00 209/17 |
| 3,399,771 | A * | 9/1968 | Hryniowski | B03B 11/00 209/245 |

(Continued)

OTHER PUBLICATIONS

International Search Report and Written Opinion of the International Searching Authority, PCT/US2016/025225 dated Jun. 30, 2016.

*Primary Examiner* — Joseph C Rodriguez

(74) *Attorney, Agent, or Firm* — Prasad IP, PC

(57) ABSTRACT

A vibratory screener apparatus has a housing with upper and lower ends, the lower end having a first mounting area characterized by a first attachment diameter. A drive assembly is employed to vibrate the apparatus. The drive assembly has a second mounting area characterized by a second attachment diameter to mount the frame to the drive assembly. An adapter frame is disposed between the drive assembly and the lower end of the housing. The adapter frame has a first end and a second end, the first end is characterized by the first attachment diameter and is attached to the lower end of the housing. The second end is characterized by the second attachment diameter and attached is to the drive assembly.

7 Claims, 2 Drawing Sheets

(56) References Cited

U.S. PATENT DOCUMENTS 3,463,727 A * 8/1969 Fahey ..... B01D 35/20 209/257
3,483,977 A * 12/1969 Westfall ..... B07B 1/38 209/332
3,485,363 A 12/1969 Talley, Jr.
3,511,373 A 5/1970 McKibben et al.
3,794,165 A 2/1974 Riesbeck et al.
4,103,902 A 8/1978 Steiner et al.
4,276,157 A * 6/1981 Haight ..... B07B 1/42 209/246
4,319,995 A * 3/1982 Haight ..... B07B 13/00 209/481
4,613,432 A * 9/1986 Racine ..... B07B 1/06 209/254
4,875,999 A * 10/1989 Haight ..... B07B 1/38 209/245
4,961,722 A 10/1990 Taylor et al.
5,799,799 A * 9/1998 Alamzad ..... B07B 1/42 209/365.1
6,003,679 A * 12/1999 Maroscher ..... B07B 1/42 209/326
6,089,380 A * 7/2000 Hazrati ..... B01D 46/0053 209/268
6,698,593 B1 * 3/2004 Folke ..... B07B 1/46 209/319
6,829,840 B1 12/2004 Stone
6,845,868 B1 1/2005 Krush et al.
7,182,206 B2 2/2007 Hukki et al.
8,869,988 B2 10/2014 Stachura et al.
9,010,540 B2 * 4/2015 Smith ..... B07B 1/06 209/257
2002/0014449 A1 2/2002 Rios et al.
2007/0045158 A1 * 3/2007 Johnson ..... B07B 1/06 209/11
2009/0071878 A1 * 3/2009 Bosse ..... B07B 1/06 209/391
2010/0236992 A1 9/2010 Fux
2012/0024764 A1 * 2/2012 Krush ..... B07B 1/38 209/326
2013/0306576 A1 11/2013 Bosio et al.
2016/0348966 A1 * 12/2016 Alamzad ..... F26B 11/026

* cited by examiner

VIBRATORY SCREENER WITH AN ADAPTER FRAME

RELATED APPLICATIONS

This application claims the benefit of provisional application No. 62/143,618 filed on Apr. 6, 2015.

FIELD OF THE INVENTION

This invention relates to machinery for separating bulk solid materials from solids and slurries and more particularly to vibratory screeners.

BACKGROUND

Circular vibratory screeners (also called separators and sieves) separate bulk solid materials from solids and slurries typically using multi-plane, inertial vibration that causes particles to pass through apertures in the screen or to travel across the screen surface in controlled pathways. Typical applications include sifting, scalping, classifying, de-dusting and de-lumping of dry bulk solids, or dewatering of solids-laden slurries. Such screeners may be gravity-fed or in-line pneumatic for batch or continuous operation, and may be used in accordance with industrial, food, dairy and pharmaceutical standards.

While the range of models and options provide a wide range of options to users of the screeners, they impose cost and complexity on the manufacturer as well as customers that may acquire multiple screeners.

SUMMARY

Embodiments disclosed herein provide flexibility in usage of screeners of different sizes with one drive assembly and thereby reduce cost and complexity in usage and configuration of vibratory screeners.

In one aspect, an adapter frame that permits attachment of a drive assembly to a housing of a circular vibratory screener comprises a drive assembly mounting element characterized by a first attachment size for attaching a first end of the adapter frame to the drive assembly, and a housing mounting element characterized by a second attachment size for attaching a second end of the adapter frame to the housing. In certain embodiments, the first attachment size is larger than the second attachment size. In other embodiments, the first attachment size is smaller than the second attachment size, and in other embodiments, the first attachment size is the same as the second attachment size.

In another aspect, a vibratory screener has a housing with upper and lower ends, the lower end having a first mounting area characterized by a first attachment diameter. The apparatus also has a drive assembly for vibrating the apparatus and has a second mounting area characterized by a second attachment diameter to mount the frame to the drive assembly. An adapter frame is disposed between the drive assembly and the lower end of the housing, the adapter frame having a first end and a second end, the first end characterized by the first attachment diameter and attached to the lower end of the housing, the second end characterized by the second attachment diameter and attached to the drive assembly. In certain embodiments, the first attachment diameter is larger than the second attachment diameter, and in other embodiments, the first attachment diameter is smaller than the second attachment diameter, while in other embodiments, the first attachment diameter is the same as the second attachment diameter.

In another aspect, a vibratory screener comprises a cover having a material inlet port, a spacing frame attached to the cover and having a material outlet port and a screen positioned at a lower end of the spacing frame. An adapter frame is removably attached to the spacing frame and has a first end with a diameter substantially the same as a diameter of the spacing frame and has a second end with a diameter smaller than the diameter of the first end. A discharge frame is removably attached to the adapter frame and having a diameter substantially the same as the diameter of the second end of the adapter frame, and a drive assembly is removably mounted to the discharge frame. In certain embodiments, the spacing frame is removably attached to the cover.

Additional aspects related to the invention will be set forth in part in the description which follows, and in part will be apparent to those skilled in the art from the description, or may be learned by practice of the invention. Aspects of the invention may be realized and attained by means of the elements and combinations of various elements and aspects particularly pointed out in the following detailed description and the appended claims. It is to be understood that both the foregoing and the following descriptions are exemplary and explanatory only and are not intended to limit the claimed invention or application thereof in any manner whatsoever.

BRIEF DESCRIPTION OF THE DRAWINGS

The accompanying drawings, which are incorporated in and constitute a part of this specification exemplify the embodiments of the present invention and, together with the description, serve to explain and illustrate principles of the inventive techniques. Specifically.

DETAILED DESCRIPTION

In the following detailed description, reference will be made to the accompanying drawing(s), which show by way of illustration, and not by way of limitation, specific embodiments and implementations consistent with principles of the present invention. These implementations are described in sufficient detail to enable those skilled in the art to practice the invention and it is to be understood that other implementations may be utilized and that structural changes and/or substitutions of various elements may be made without departing from the scope and spirit of present invention. The following detailed description is, therefore, not to be construed in a limited sense.

Figure 1:
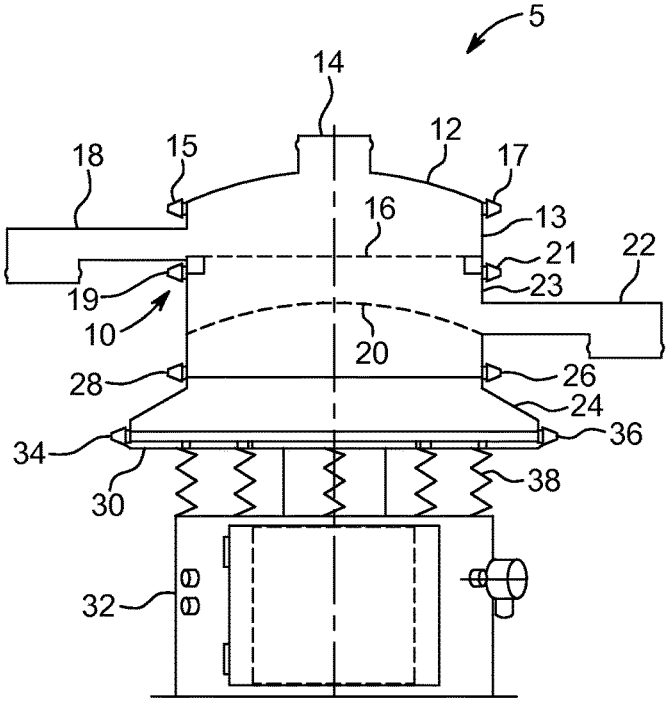
FIG. 1 illustrates a first embodiment of a circular vibratory screener employing the principles of the invention.

FIG. 1 illustrates an embodiment of a circular vibratory screener 5 employing the principles of the invention. A cylindrical housing comprising a plurality of components described herein, and generally designated 10, is covered by a cover 12. Material is fed into the housing 10 via material inlet port 14 onto the center of screen 16, causing particles larger than screen apertures to travel across the screen surface in controlled pathways, and exit through a discharge spout 18 located at the screen's periphery, while particles smaller than screen apertures pass through the screen onto lower dome 20 and exit through lower discharge spout 22. The dome 12 is clamped to spacing frame 13 via clamps 15, 17. The spacing frame 13 is clamped to discharge frame 23 via clamps 19, 21.

The housing 10 is attached to an upper end of adapter frame 24 by way of a plurality of clamps two of which are shown at 26 and 28. The lower end of adapter frame 24 is attached to a drive plate 30 of drive assembly 32 by way of a plurality of clamps, two of which are shown at 34 and 36. The drive plate 30 is attached on its lower surface to a plurality of springs 38. This permits the portions above the drive plate 30, in other words, the main screening assembly of screener 5 to be suspended on springs 38 that allow the main screening assembly to vibrate freely while minimizing power consumption and preventing vibration transmission to the floor. The drive assembly 32 is preferably equipped with one imbalanced-weight gyratory motor that creates multi-plane inertial vibration for the purpose of controlling the flow path of material on screen surface 16, and maximizing the rate at which material passes through the screen 16. While such a drive assembly is preferred, alternative drive assemblies may be employed within the principles of the invention.

Circular vibratory screeners are offered in gravity-fed and in-line pneumatic models for batch or continuous operation, and are available to industrial, food, dairy and pharmaceutical standards. To increase the screening capacity of the existing screeners, it is preferable to use one size drive assembly 32 for the different diameter screeners for the purpose of standardization. Typically in the past, a customer of such screeners had to purchase the new larger size screener to meet the desired high capacity. The embodiment shown in FIG. 1 reduces this need by way of adapter frame 24 which permits different housings 10 which can be of different diameters in order to accommodate different diameter screens 16 to be used with a single drive assembly 32.

Preferably, the adapter frame 24 has a conic shape, one end has a big diameter and the other end has a small diameter. In FIG. 1, the upper end of adapter frame 24, which is attached to housing 10 is smaller than the lower end of the adapter frame which is attached to the drive plate 30. The adapter frame 24 in FIG. 1 therefore permits a housing 10 that is smaller than the drive plate 30 to be mounted to the drive assembly 32.

Figure 2:
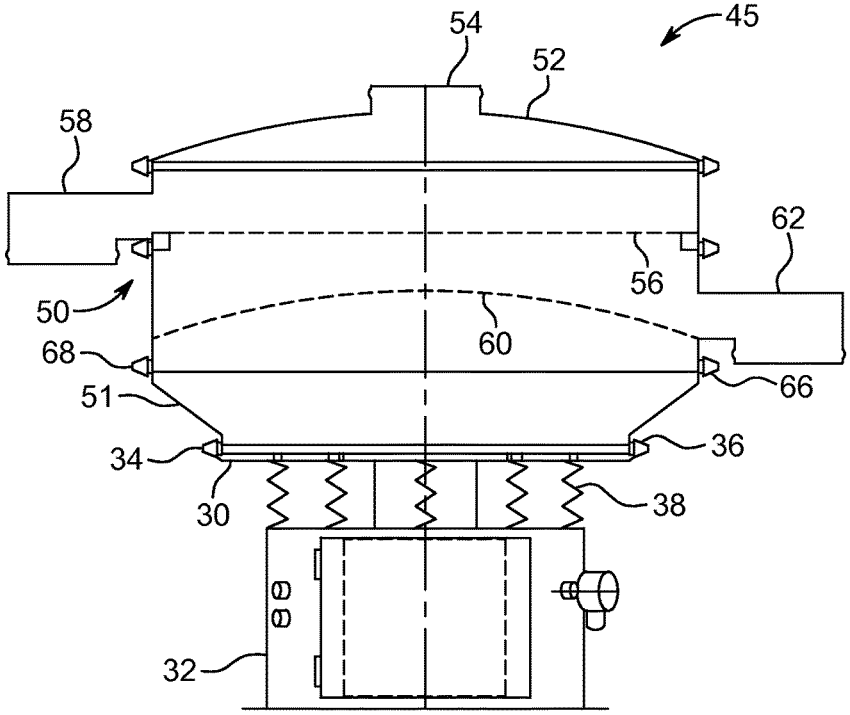
FIG. 2 illustrates a second embodiment of a circular vibratory screener employing the principles of the invention.

FIG. 2 illustrates a screener 45 that employs a housing 50 having a diameter larger than that of drive plate 30. In screener 45, adapter frame 51 has a lower end mounted to drive plate 30 and an upper end, which has a diameter larger than the diameter at the lower end, is mounted to a lower end of housing 50. As seen, the adapter frame 51 permits the housing 50 which has a diameter that is different, and larger than the housing 10 to be mounted to the same drive assembly 32. Cover 52, material inlet port 54, screen 56, discharge spout 58, dome 60, lower discharge spout 62, and clamps 66, 68 operate similarly to their corresponding elements as described in connection with FIG. 1.

Figure 3:
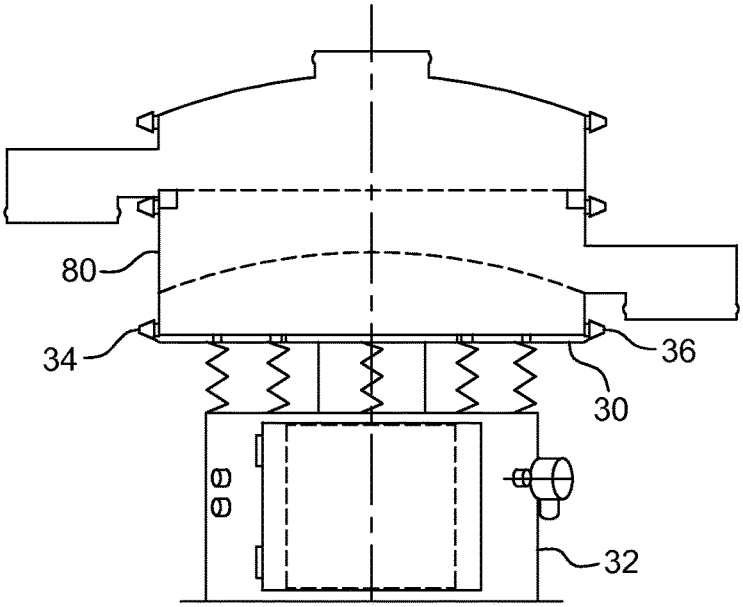
FIG. 3 illustrates a circular vibratory screener that may be adapted to employ an adapter frame as disclosed herein.

The drive plate 30 may be mounted directly to an appropriately sized housing, as shown in FIG. 3. In such an embodiment an adapter frame is not required. As seen in FIG. 3, the drive assembly 32 is the same as in the embodiments of FIG. 1 and FIG. 2. The drive assembly 30 is mounted directly to housing 80 by way of drive plate 30 and clamps 34 and 36.

Figure 4:
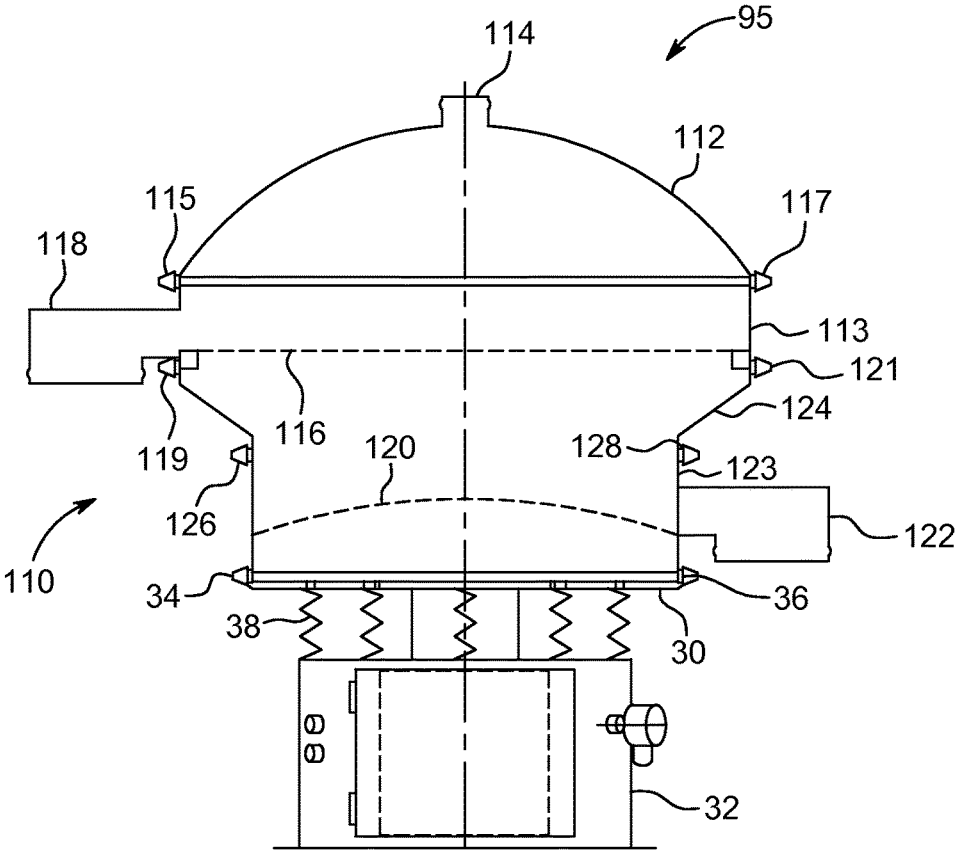
FIG. 4 illustrates a third embodiment of a circular vibratory screener employing the principles of the invention.

FIG. 4 illustrates another embodiment where the adapter frame 124 is disposed between the spacing frame 113 and the discharge frame 123. In FIG. 4, cover 112 is mounted to spacing frame 113 by way of clamps 115 and 117. Screen 116 is disposed between spacing frame 113 and adapter frame 124. Clamps 119 and 121 attach spacing frame 113 to adapter frame 124, which is attached at its lower end to discharge frame 123 by way of clamps 126 and 128. Discharge frame 123 is mounted to drive plate 30 by way of claims 34 and 36. The adapter frame 124 in the embodiment of FIG. 4 permits usage of a different diameter, in this case larger diameter screen 116, spacing frame 113 to be used with discharge frame 123.

The clamps as referred to herein may take the form of V-shaped clamps or alternatively may be replaced by bolts.

While the invention has been described in connection with a preferred embodiment, it is not intended to limit the scope of the invention to the particular form set forth, but on the contrary, it is intended to cover such alternatives, modifications, and equivalents as may be within the spirit and scope of the invention as defined by the appended claims.

In the foregoing specification, the invention has been described with reference to specific embodiments thereof. It will, however, be evident that various modifications and changes may be made thereto without departing from the broader spirit and scope of the invention. The specification and drawings are, accordingly, to be regarded in an illustrative rather than a restrictive sense.

What is claimed is:

1. A vibratory screener apparatus having:

a housing with upper and lower ends, the lower end having a first mounting area characterized by a first attachment diameter;

a drive assembly that contains a motor for vibrating the apparatus, and having a second mounting area characterized by a second attachment diameter, different from the first attachment diameter, to mount an adapter frame to the drive assembly; and the adapter frame disposed between the drive assembly and the lower end of the housing, the adapter frame having a first end and a second end, the first end characterized by the first attachment diameter and attached to the lower end of the housing, the second end characterized by the second attachment diameter and attached to the drive assembly, wherein the first attachment diameter is larger than the second attachment diameter.

2. A vibratory screener apparatus comprising:

a cover having a material inlet port;

a spacing frame attached to the cover and having a material outlet port and a screen positioned at a lower end of the spacing frame;

an adapter frame removably attached to the spacing frame and having a first end with a diameter substantially the same as a diameter of the spacing frame and having a second end with a diameter smaller than the diameter of the first end;

a discharge frame removably attached to the adapter frame and having a diameter substantially the same as the diameter of the second end of the adapter frame; and a drive assembly removably mounted to the discharge frame.

3. The vibratory screener apparatus of claim 2 where the spacing frame is removably attached to the cover.

4. The vibratory screener apparatus of claim 2 wherein the drive assembly comprises an imbalanced-weight gyratory motor.

5. A vibratory screener apparatus having:

a housing with upper and lower ends, the lower end having a first mounting area characterized by a first attachment diameter;

a drive assembly that contains a motor for vibrating the apparatus, and having a second mounting area characterized by a second attachment diameter, different from the first attachment diameter, to mount an adapter frame to the drive assembly; and the adapter frame disposed between the drive assembly and the lower end of the housing, the adapter frame having a first end and a second end, the first end characterized by the first attachment diameter and attached to the lower end of the housing, the second end characterized by the second attachment diameter and attached to the drive assembly, wherein the adapter frame is attached to the drive assembly by way of a drive plate, the drive plate attached on a lower surface to a plurality of springs that are attached to a motor.

6. The vibratory screener apparatus of claim 2 wherein the adapter frame is characterized by a conical shape.

7. The vibratory screener apparatus of claim 2 wherein the spacing frame and the discharge frame are substantially cylindrical in shape.

* * * * *